US005317112A

United States Patent [19]

Lee

[11] Patent Number: 5,317,112

[45] Date of Patent: May 31, 1994

[54] INTAKE SILENCER OF THE VARIABLE TYPE FOR USE IN MOTOR VEHICLE

[75] Inventor: Keeho Lee, Seoul, Rep. of Korea

[73] Assignee: Hyundai Motor Company, Seoul, Rep. of Korea

[21] Appl. No.: 778,016

[22] Filed: Oct. 17, 1991

[51] Int. Cl.[5] ..... F01N 1/02

[52] U.S. Cl. ..... 181/250; 181/254; 60/312; 60/314

[58] Field of Search ..... 181/215, 216, 219, 226, 181/229, 236, 237, 241, 250, 254, 273, 276, 227, 228; 60/312, 313, 314, 324

[56] References Cited

U.S. PATENT DOCUMENTS

| | | | |
|---|---|---|---|
| 3,703,937 | 11/1972 | Tenney | 181/226 |
| 4,136,756 | 1/1979 | Kawamura | 181/229 |
| 4,320,815 | 3/1982 | Norris | 181/226 |
| 4,350,223 | 9/1982 | Takei | 181/229 |
| 4,539,813 | 9/1985 | Tomita et al. | 60/314 |
| 4,539,947 | 9/1985 | Sawada et al. | 181/220 X |
| 4,546,733 | 10/1985 | Fukami et al. | 181/229 X |
| 4,552,029 | 6/1985 | Tomita et al. | 60/314 |
| 4,800,985 | 1/1989 | Hanzawa | 181/229 |
| 4,874,062 | 10/1989 | Yanagida et al. | 181/250 |

FOREIGN PATENT DOCUMENTS 61-41813 3/1986 Japan .

61-41815 3/1986 Japan .

*Primary Examiner*—Michael L. Gellner
*Assistant Examiner*—Khanh Dang
*Attorney, Agent, or Firm*—Handal & Morofsky

[57] ABSTRACT

An intake silencer of the variable type is for reducing noise generated coming from the difference between the inner pressure and the outer pressure of a combustion chamber when an intake valve being opened or closed. The present invention for reducing noise comprises a signal processing part, a signal comparing part and a valve driving part. In the signal processing part, a RPM sensor modulates a waveform obtained by detecting the revolution number of the engine and a F/V converter changes it thereafter emitting a signal to the signal comparing part. In the signal comparing part, a plurality of comparators emit the opened and closed signal to a valve driver by comparing a output signal emitted from the signal processing part with a basic signal. In the valve driving part, when the corresponding valve driver turns on or off by virtue of the signal emitted from the corresponding comparator, a corresponding actuator opens or closes the corresponding valve dividing the inside of the side branch. Thus, it can rapidly change its capacity according to the change of the revolution number of the engine and also has the simple structure and the small size.

13 Claims, 5 Drawing Sheets

Overall Noise
×-----×: Non-Carried Type
△-----△: Conventional Type
○-----○: Present Invention Type Second Order Noise
×——×: Non-Carried Type
△——△: Conventional Type
○——○: Present Invention Type

INTAKE SILENCER OF THE VARIABLE TYPE FOR USE IN MOTOR VEHICLE

FIELD OF THE INVENTION

The present invention relates to an intake silencer and more in particular to an intake silencer for reducing noise generated from an air intake system of motor vehicle engine.

BACKGROUND OF THE INVENTION

The generation of noise from an engine system used for a motor vehicle is caused by the engine system itself, a piston system or an intake system. Among them, noise from the intake system is generated coming from the difference between the inner pressure and the outer pressure of a combustion chamber when an intake valve being opened or closed. It is transmitted therefrom to an air cleaner and then dispersed toward the outside.

The intake noise is influenced by the frequency, generally the low frequency, related with the revolution number of an engine.

As well-known, noise generated due to the low frequency should be eliminated if possible since it resonates a vehicle body itself to produce noise inside the motor vehicle.

Kawamura's U.S. Pat. No. 4,136,756 provides a suction air muffler for motorcycle effective to prevent producing noise which would otherwise be produced by air drawn by suction into the inlet of the motorcycle. Takai's U.S. Pat. No. 4,350,223 provides a silencer for reducing noise produced by air drawn into the engine such that a resonance chamber is placed on a conduct connected to an air cleaner and porous metal tubes connect the space inside the chamber to the conduct. Hanzawa et al U.S. Pat. No. 4,800,985 proposes an intake air silencer including a side branch tube which is flexible at least partially for installation in a limited space, placed on an intake tube connected to an air cleaner to reduce noise.

As described above, many kinds of silencers for reducing the air intaking noise into the engine have been commercially used. Generally, they are divided into two types. One is a side branch type silencer, which can reduce noise by virtue of the mutually interfering of sonic waves according to quarter wave filter theory. Another is a cavity type silencer, which can silence noise by changing a wave energy of a sonic wave into a going and coming energy at the inside of a resonance chamber.

The present invention is related with an improvement of the side branch type silencer. FIG. 5 shows a basic structure of the side branch type silencer. The resonance chamber B is formed on an air intake tube in the form of connecting with each other, so that, when the air intaking noise arrives at the inside of the intake tube, it resonates the resonance chamber B. The mutual interference between resonating wave and noise occurs therein thereby reducing noise.

The engine provided with the silencer of this type is known to obtain the improved horse power and fuel consumption ratio as a graph shown in FIG. 6 since the path of the intake tube with a limited space has the sufficient amount of existed therein, air thereby causing the high charging efficiency of air drawn into the inside of a cylinder. The theoretical reduction of noise frequency of the side branch type silencer can represent $F=C/4L$ as a formula, C is an acoustic velocity and L is the length of the resonance chamber. This formula means that the effective length of the resonance chamber can be variable to widen the reducible low frequency region. Thus, if the length or the capacity of the resonance path varies with the change of the RPM sensor of the engine, the preferred efficiency of noise reduction can be obtained.

Japanese Specification No. 86-41815 proposes the silencer of the variable type such that some short and long pipes connect the path of the intake tube with the resonance box and entrances of the pipes are provided with the opened and closed valves. Each opened and closed valve gears with the revolution of the engine thereby forming the simple structure and effectively reducing noise independently of the change of the engine revolution. However, the pipes interposed between the intake path and the resonance box can not help having a large size unfit for the limited engine chamber. Japanese Specification No. 61-41813 provides the silencer such that a piston placed at the inside of the resonance tube slides by a stepping motor corresponding to the engine revolution thereby increasing and/or decreasing the cavity of the resonance chamber, so that such problem can be solved. The invention has the advantage of minimizing the size of the silencer. However, since a tool of the piston type slides riding on a screw rod rotated by the stepping motor, the complex structure can be formed. Especially, the piston can not be rapidly changed immediately when the revolution number of the engine is changed thereby causing the poor efficiency of noise reduction though in a moment.

SUMMARY OF THE INVENTION

Accordingly, the feature of the present invention is a silencer with a side branch which can rapidly change its capacity according to the revolution number of the engine though it has the simple structure and the small size. The present invention comprises a signal processing part, a signal comparing part and a valve driving part. In the signal processing part, a RPM sensor modulates a waveform obtained by detecting the revolution number of the engine and a F/V converter changes it thereafter emitting a signal to the signal comparing part. In the signal comparing part, a plurality of comparators emit the opened and closed signal to a valve driver by comparing a output signal emitted from the signal processing part with a basic signal. In the valve driving part, when the corresponding valve driver turns on or off by virtue of the signal emitted from the corresponding comparator, a corresponding actuator opens or closes the corresponding valve dividing the inside of the side branch. Thus, such processing steps help to reduce noise.

BRIEF DESCRIPTION OF THE DRAWINGS

Further features and advantages of the present invention will be apparent in the following detailed description in connection with the accompanying drawings, in which.

DETAILED DESCRIPTION OF THE PRESENT INVENTION

Figure 1:
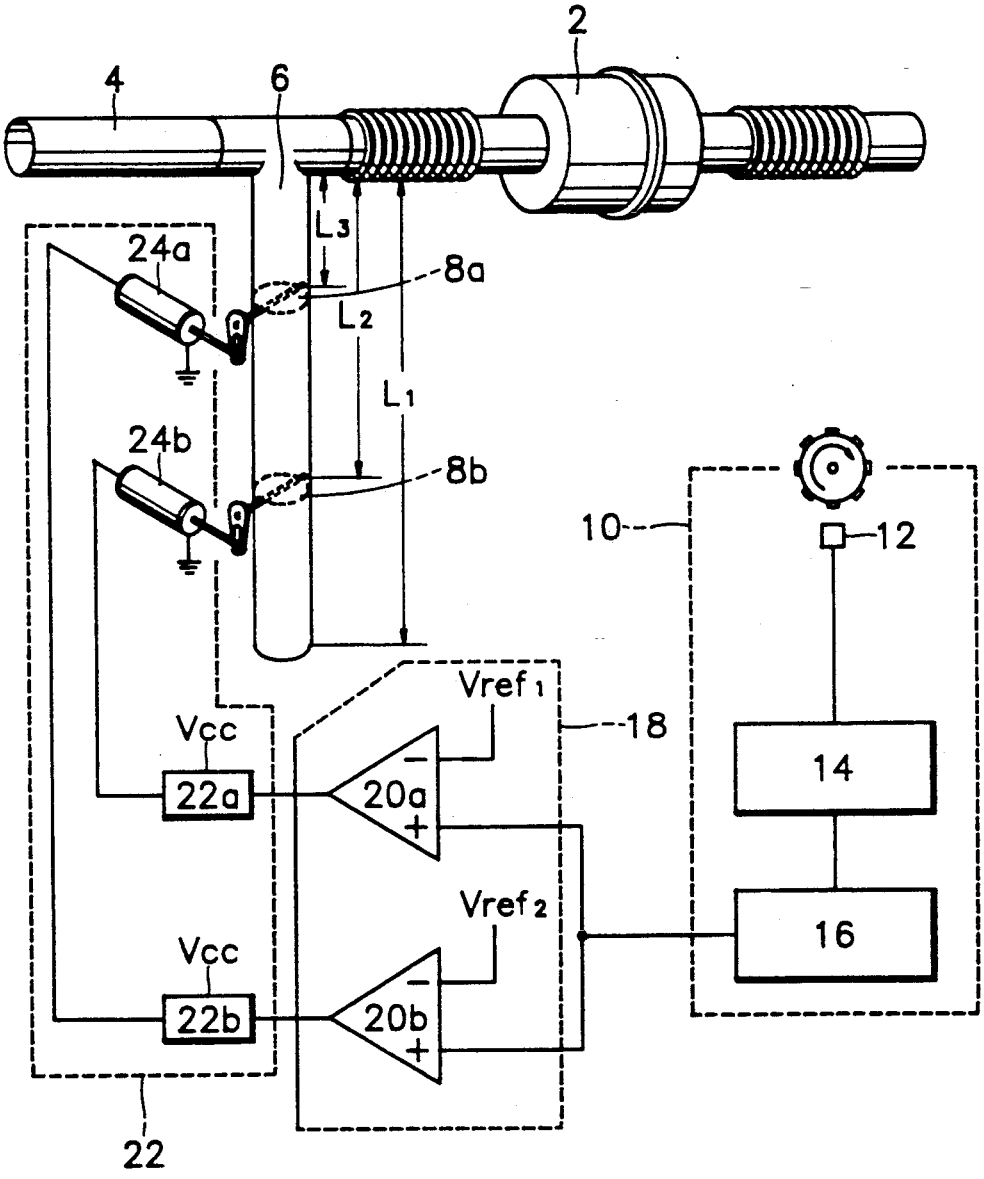
FIG. 1 is a gist view of a silencer related with the present invention.

FIG. 1 shows a silencer according to an embodiment of the present invention, which is incorporated in an automatic internal combustion engine (not shown). The silencer includes an air passage tube 4 serving as an intake tube. The air intake tube 4 is connected to an air cleaner 2. The silencer also includes a side branch tube 6 which is connected to the lower side of the air intake tube 4. The side branch tube 6 comprises a first valve 8*a* and a second valve 8*b* to partition its inside by stages.

The change of the capacity corresponding to the opening and/or closing the first and second valve will be shown as follows:

| Change of Capacity | Opened and Closed State of Valve | |
|---|---|---|
| | First Valve | Second Valve |
| Maximum | Opened | Opened |
| Medium | Opened | Closed |
| Minimum | Closed | Closed |

A conventional RPM sensor 12 connected to a crank axis of the engine detects its revolution number to emit pulse to an signal processor 14 of a signal processing part 10. It modulates pulse therefrom into wave shape to apply to a F/V converter 16. It change the modulated wave into voltage to emit to a signal comparing part 18 as a output signal. The signal comparing part 18 comprises a first comparator 20*a* connected to the first valve and a second comparator 20*b* connected to the second valve 8*b*. The basic voltage is differently applied to each comparator. The basic voltage(Vref1) of the first comparator(20*a*) is less than that of the second comparator(20*b*). Thus, only when the output signal more than the basic voltage is applied thereto, a signal is outputted to a valve driving part 22. The valve driving part 22 is operated according to the signal emitted from the comparators 20*a*,20*b*. The valve driving part 22 comprises a first switching element 22*a* into which the signal emitted from the first comparator 20*a* is inputted and a second switching element 22*b* into which the signal emitted from the second comparator 20*b* is inputted. A conventional switching transistor is appropriate for the switching element. When the signal therefrom turns on the switching elements 22*a*,22*b*, they output the driving voltage (Vcc). The valve driving part also comprises a first and second actuator 24*a*,24*b* connected to the first and second valve 8*a*,8*b* at the end of outputting.

Figure 2A:
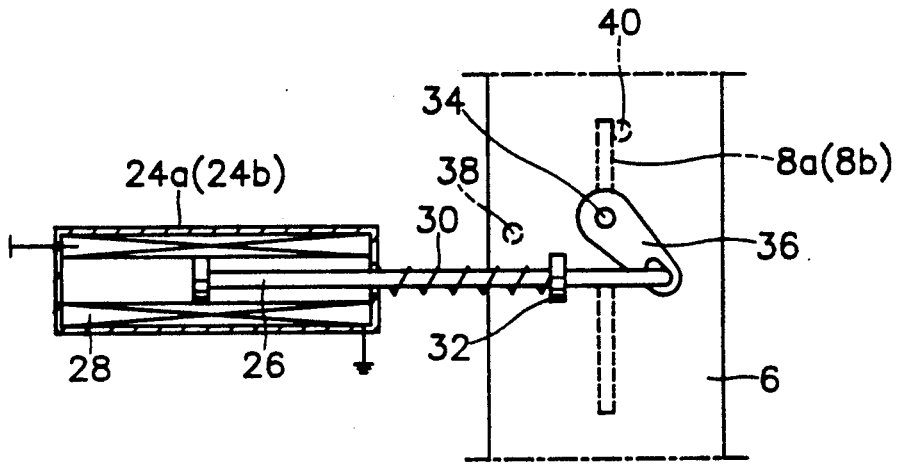
FIGS. 2A & 2B are a sectional side view showing an opening and closing operation of FIG. 1.
Figure 2B:
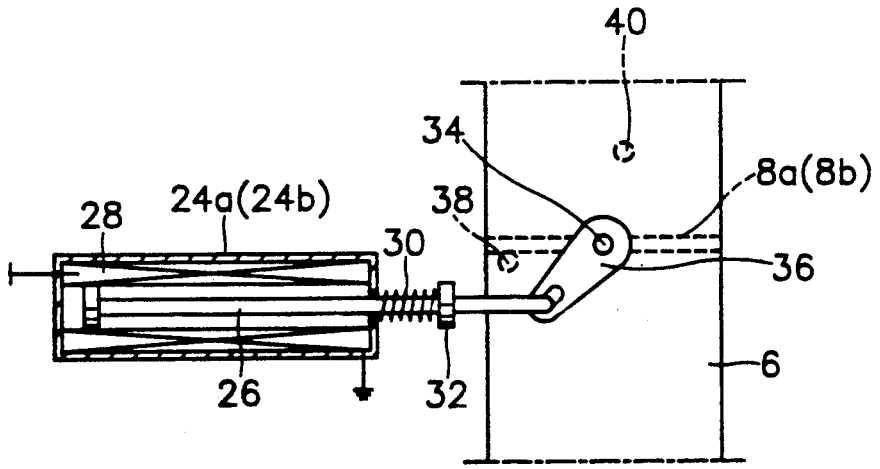

FIGS. 2A & 2B shows a connection of the first actuator 24*a* to the corresponding first valve 8*a* as example. FIG. 2A shows a opened state of the valve 8*a*.

The actuator 24*a* comprises a push rod 26 for sliding at the center of its inside and a magnetized coil 28 wound around the push rod 26. An elastic spring 30 wound on the push rod exposed outside the actuator 24*a* is supported by a spring sheet 32. The end of the push rod 26 is linked with an arm 36 fixed on the supporting axis 34 enabling the first valve 8*a* to rotate. When the push rod 26 is influenced by the elastic spring to protrude the outside thereby rotating the arm, the first valve 8*a* opens the entrance of the side branch 6. The rotation angle of the valve 8*a* makes a right angle with the inside of the side branch 6 and that is regulated by a stopper 38,40 projected on the valve 8*a*. When the first switching element 22*a* is turned on at the opened state of the valve 8*a*, the magnetized coil 28 of the actuator 24*a* is supplied with the voltage for the valve 8*a* to be adhered as shown in FIG. 2B. At that time, whereas the reactionary energy is saved in the elastic spring 30, the arm 36 closes the first valve 8*a* by rotating it. When the first switching element 22*a* is again turned off, the push rod 26 returns to the original position by the applied reactionary energy of the elastic spring 30 due to the magnetized coil 28's losing the adhering power. Thus, the first valve 8*a* is opened. The above description can be applied to the second valve 8*b* as well.

Figure 3:
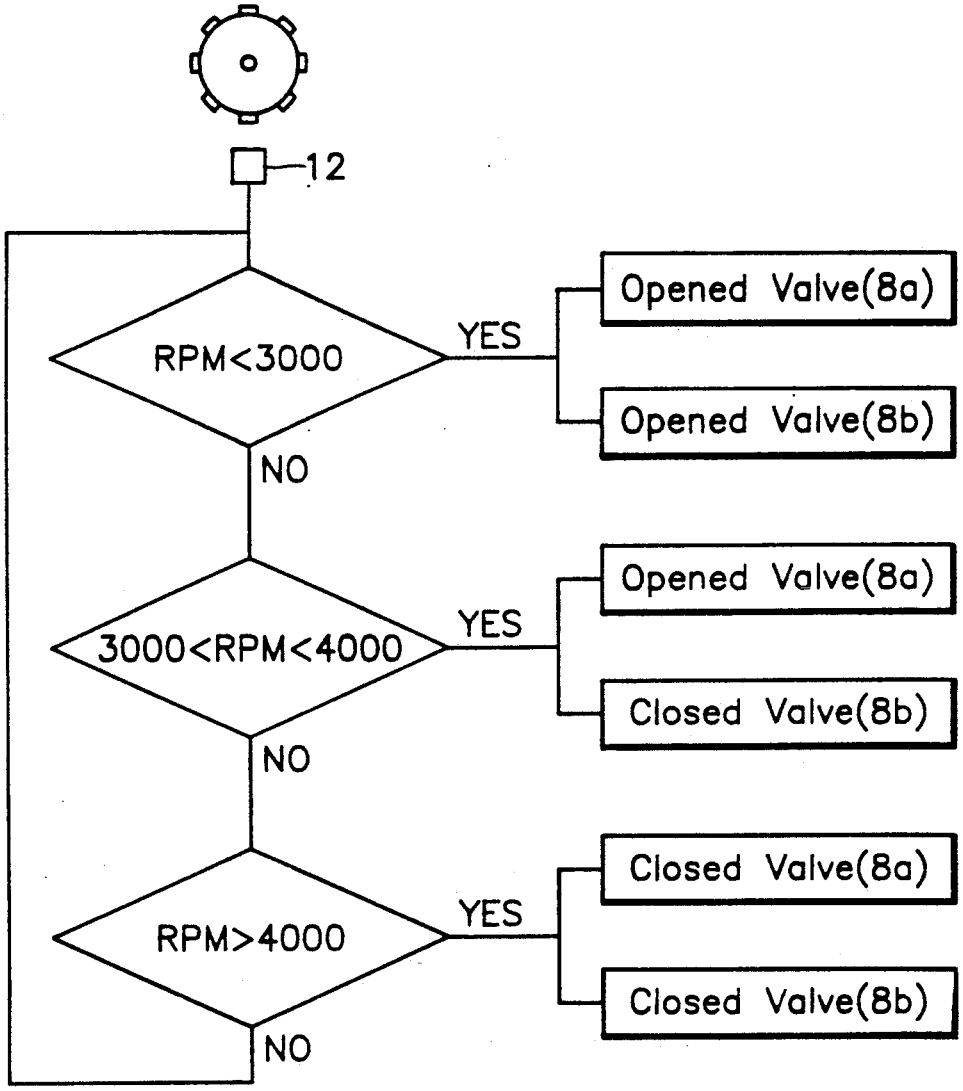
FIG. 3 is a flow diagram explaining a operating order of a controller of FIG. 1.

FIG. 3 shows a flow chart of the operation of a controller.

The frequency detected by the RPM sensor 12 is inputted to the F/A converter 16 to change the voltage, which is outputted to the comparator 18. At that time, the frequency is proportional to the voltage, so that if the revolution number of the engine is reduced, the voltage becomes lower or if the frequency is increased, the voltage becomes high.

Thus, the basic voltage(Vref1) of the first comparator(20*a*) according to the subject embodiment of the present invention is less than the output voltage from the F/V converter 16 at the middle speed region of the engine. The basic voltage(Vref2) of the second comparator(20*a*) according to the subject embodiment of the present invention is higher than the output voltage from the F/V converter 16 at the lower speed region of the engine.

As a result, at the lower speed region, the signal is emitted to the end of the output of each comparator 20*a*, 20*b* to open each valves 8*a*,8*b*, so that the side branch 6 has a maximum capacity indicated by length L1. At the middle speed region, the only first comparator 20*a* emits the signal to open the only first valve 8*a*, so that the side branch 6 has a medium capacity indicated by length L2. At the high speed region, each valve 8*a*,8*b* is closed for the side branch to have a minimum capacity indicated by length L3. As shown in FIG. 1, the length of the side branch 6 between the air intake 4 and the end wall of the side branch 6, or the effective length between the air intake 4 and the effective end wall constituted by a closed valve 8*a* or 8*b*, is indicated by the respective lengths L3, $L_1$, and $L_2$. Because side branch tube 6 is a straight tube with a constant cross-sectional profile, its length or effective length indicates its volume or capacity.

More particularly, the lower speed region of the engine is under 300 RPM. The middle speed region is above 3000 RPM and under 4000 RPM. The high speed region is above 4000 RPM. The basic voltage (Vref1) of the first comparator 20*a* is less than the output voltage of the F/V converter 16 at the middle speed region. The basic voltage (Vref1) of the first comparator 20*a* is higher than the output voltage of the F/V converter 16 at the high speed region. The basic voltage (Vref2) of the second comparator 20*b* is higher than the output voltage of the F/V converter 16 at the lower speed region and is higher than the output voltage of the F/V converter 16 at the middle speed region.

Thus, when both basic voltages are respectively set up, each comparator 20a,20b independently emits the signal according to the lower, middle or high speed region of the revolution number of the engine. As a result, at the lower speed region, each valve 8a,8b is opened, so that the side branch 6 has the maximum capacity indicated by length L1. At the middle speed region, the only first valve 8a is opened, so that the side branch 6 has the medium capacity indicated by length L2. At the high speed region, each valve 8a, 8b is closed for the side branch to have the minimum capacity indicated by length L3.

Figure 4:
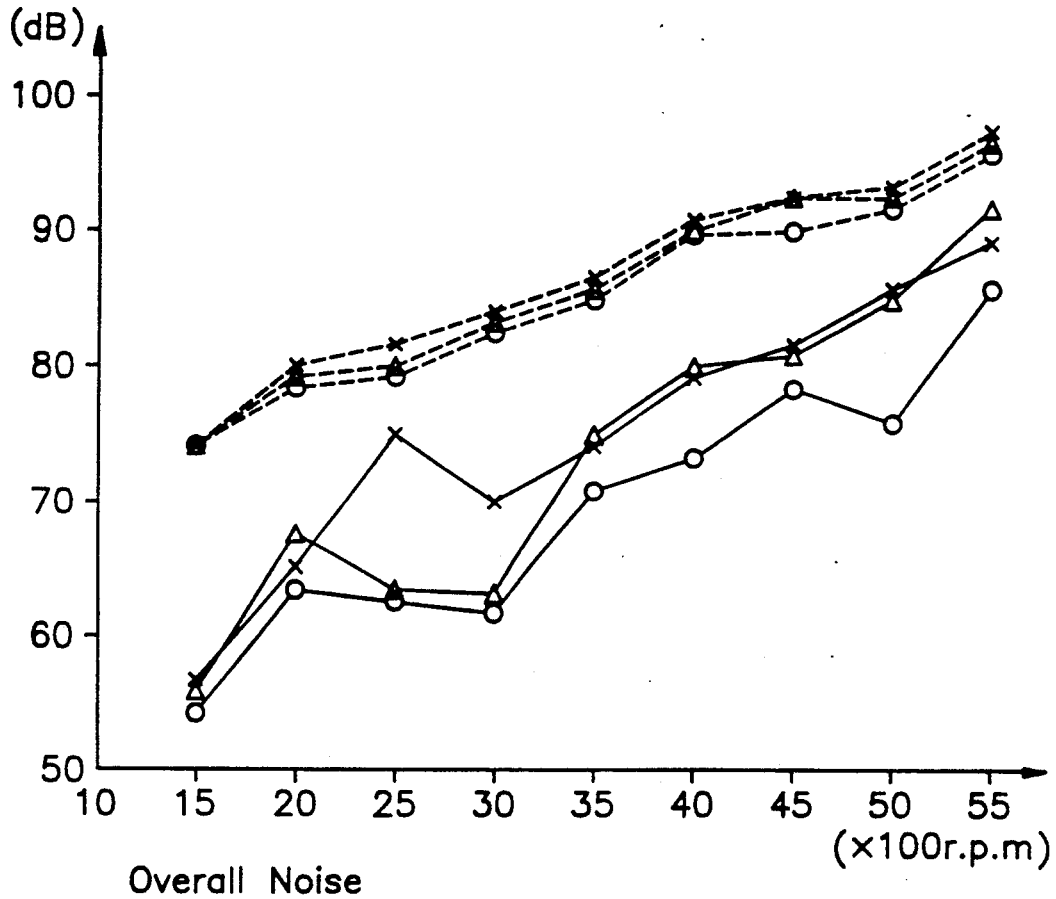
FIG. 4 is a graph of the comparison of noise reducing efficiency between the present invention and the conventional silencer.
Figure 5:
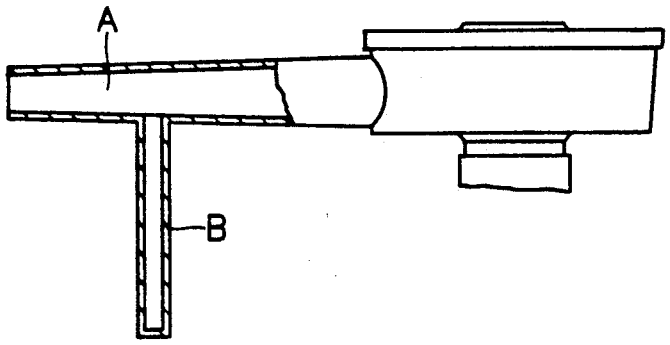
FIG. 5 is a sectional view of an embodiment of the conventional silencer.
Figure 6:
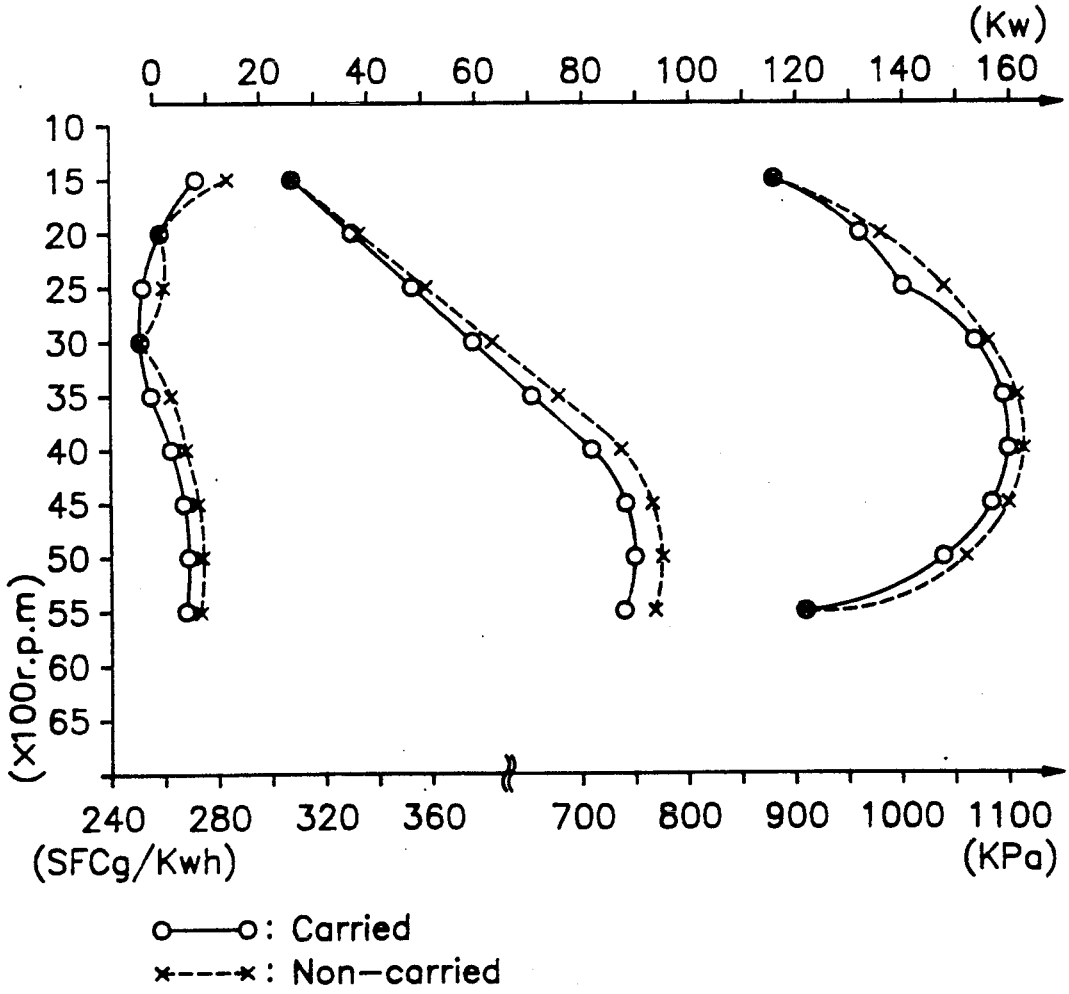
FIG. 6 is a graph explaining the horse power and the fuel consumption ratio of FIG. 5.

FIG. 4 shows a measurement of noises divided as an overall noise and a second order noise at intervals of 1 meter, respectively generated from an engine without a silencer, an engine having a conventional silencer shown in FIG. 5 and an engine provided with a side branch type silencer of the present invention.

The present invention has the consistent efficiency of noise reduction independently of the change of the revolution number of the engine and is very effective to the reduction of the second order noise.

Thus, the present invention is simple in structure and small in size to easily install in a limited space of the engine. Also, the length of the side branch can rapidly vary with the change of the revolution number of the engine to obtain the good efficiency of noise reduction. Especially, when the side branch has a single and flexible type, the easier installation can be obtained.

What is claimed is:

1. A motor vehicle intake silencer having a variable-length resonance chamber, said length being rapidly changeable in response to engine speed by varying the effective length of said resonance chamber, said silencer comprising:

a side branch resonator tube communicable with a vehicle air intake tube to extend transversely of said air intake tube and constitute a variable length resonance chamber, said resonator tube having an end wall remote from said air intake tube and defining a first effective length of said resonator tube, said resonator tube also having a substantially constant inside cross-sectional profile along said first effective length from said air intake tube to said end wall;

at least one divider valve disposed in said resonator tube intermediately of said first effective length, said divider valve having a valve element adapted for movement transversely of said resonator tube into a tube-closing position in which said resonator tube has a further effective length shorter than said first effective length wherein an open position of each at least one said divider valve provides a straight-line resonance path between said intake tube and said end wall;

a valve actuator to operate each said divider valve selectively to close or open it in response to engine speed changes;

a valve controller coupled to each said valve actuator and including an engine speed detector, said valve controller being operative on each said valve actuator in response to a predetermined engine speed change;

whereby said first effective length of said resonator tube is selected to provide quarter-wave resonant noise reduction at a first engine speed range and each said further effective length is selected to provide enhanced noise reduction at a further engine speed range.

2. An intake silencer according to claim 1 wherein each said divider valve is a butterfly valve provided with stops for a full-flow open position and a fully closed position perpendicular to said open position, said valve element comprising a disk mounted for rotation about an axis extending across said resonator tube.

3. An intake silencer according to claim 2 wherein each said valve actuator provides on/off valve actuation between said full-flow open position and said fully closed position.

4. An intake silencer according to claim 3 wherein each said actuator comprises an electromagnetically driven actuator member to move said valve member wherein electromagnetic impulses apply direct translational movement to said actuator member.

5. An intake silencer according to claim 4 wherein each said actuator member comprises a push rod slidably mounted axially with respect to an electromagnetic coil and said actuator comprises a pivot arm, said push rod driving said valve member through said pivot arm.

6. An intake silencer according to claim 1 comprising two of said divider valves spaced apart along said resonator tube to provide with said end wall three effective lengths for said resonator tube, said effective lengths being selected to provide effective noise reduction at each of three preselected engine speed ranges.

7. An intake silencer according to claim 6 wherein said three preselected engine speed ranges comprise low, middle and high speed ranges.

8. An intake silencer according to claim 7 wherein said middle speed range is about 3,000 to 4,000 r.p.m., said low range being below 3,000 r.p.m. and said high range being above 4,000 r.p.m.

9. An intake silencer according to claim 8 wherein each said divider valve is a fast-acting butterfly valve provided with stops for a full-flow open position and a fully closed position perpendicular to said open position, said valve element comprising a disk mounted for rotation about an axis extending across said resonator tube, each said valve actuator provides on/off valve actuation between said full-flow open position and said fully closed position, and each said actuator comprises an electromagnetically driven actuator member to move said valve member wherein electromagnetic impulses apply direct translational movement to said actuator member.

10. An intake silencer according to claim 9 wherein each said actuator member comprises a push rod slidably mounted axially with respect to an electromagnetic coil and said actuator comprises a pivot arm, said push rod driving said valve member through said pivot arm.

11. An intake silencer according to claim 1 wherein said valve controller comprises a signal processor outputting an engine-speed-related voltage signal according to signals from said engine speed detector, a comparator to compare said voltage signal with a reference signal and a switching element responsive to said comparator output to apply a valve actuating pulse to one or more of said valve actuators.

12. An intake silencer according to claim 11 wherein said valve controller comprises a plurality of said comparators and associated switches, one for each said valve actuator said comparators having different reference voltages according to the desired speed range of operation of each said divider valve.

13. An intake silencer according to claim 1 wherein said resonator tube is a flexible tube deformable for clearance and said valve element is mounted in said tube.

* * * * *